US008294532B2

(12) United States Patent
Nummerdor

(10) Patent No.: US 8,294,532 B2
(45) Date of Patent: Oct. 23, 2012

(54) DUPLEX FILTER COMPRISED OF DIELECTRIC CORES HAVING AT LEAST ONE WALL EXTENDING ABOVE A TOP SURFACE THEREOF FOR ISOLATING THROUGH HOLE RESONATORS

(75) Inventor: Jeffrey J. Nummerdor, Rio Rancho, NM (US)

(73) Assignee: CTS Corporation, Elkhart, IN (US)

( * ) Notice: Subject to any disclaimer, the term of this patent is extended or adjusted under 35 U.S.C. 154(b) by 251 days.

(21) Appl. No.: 12/683,997

(22) Filed: Jan. 7, 2010

(65) Prior Publication Data

US 2010/0141352 A1 Jun. 10, 2010

Related U.S. Application Data

(63) Continuation-in-part of application No. 12/316,233, filed on Dec. 9, 2008.

(60) Provisional application No. 61/204,594, filed on Jan. 8, 2009.

(51) Int. Cl.
*H01P 1/213* (2006.01)
*H01P 1/205* (2006.01)

(52) U.S. Cl. ..... 333/134; 333/202; 333/206

(58) Field of Classification Search ..... 333/202, 333/206, 134

See application file for complete search history.

(56) References Cited

U.S. PATENT DOCUMENTS 4,673,902 A 6/1987 Takeda et al.
4,737,746 A 4/1988 Ueno
4,837,534 A 6/1989 Van Horn
4,937,542 A 6/1990 Nakatuka
5,079,528 A 1/1992 Yorita et al.
5,144,269 A 9/1992 Itoh
5,177,458 A 1/1993 Newell et al.
5,191,305 A * 3/1993 Frost et al. ..... 333/202
5,208,566 A 5/1993 Kenoun et al.
5,214,398 A 5/1993 Hayashi
5,227,747 A 7/1993 Komazaki et al.
5,345,202 A 9/1994 Kobayashi et al.
5,486,799 A 1/1996 Komazaki et al.
5,512,866 A 4/1996 Vangala et al.
5,563,561 A 10/1996 Ishihara et al.
5,572,175 A 11/1996 Tada et al.
5,602,518 A 2/1997 Clifford, Jr. et al.
5,686,873 A * 11/1997 Tada et al. ..... 333/134
5,731,751 A 3/1998 Vangala (Continued)

FOREIGN PATENT DOCUMENTS

EP 0 865 094 9/1998

(Continued)

*Primary Examiner* — Benny Lee
(74) *Attorney, Agent, or Firm* — Daniel J. Deneufbourg

(57) ABSTRACT

A duplex filter includes a core of dielectric material with top, bottom, and side surfaces, and first and second spaced-apart sets of through-holes extending therethrough. A wall extends outwardly from the top surface to define a peripheral rim and cavity. A pattern of metallized and unmetallized areas are defined on selected core surfaces including strips of metallization on the top surface that extend onto the wall and the peripheral rim thereof to define respective transmit, receive, and antenna connection posts. In one embodiment, the core is made from two separate blocks which have been coupled together to define an interior metallized layer which separates the first and second sets of through-holes and an exterior wall on the top surface separates the respective transmit and receive conductive patterns thereon.

15 Claims, 5 Drawing Sheets

U.S. PATENT DOCUMENTS

| | | | |
|---|---|---|---|
| 5,783,978 | A | 7/1998 | Noguchi et al. |
| 5,793,267 | A | 8/1998 | Tada et al. |
| 5,959,511 | A | 9/1999 | Pasco et al. |
| 6,023,207 | A | 2/2000 | Ito et al. |
| 6,052,040 | A | 4/2000 | Hino |
| 6,204,738 | B1 | 3/2001 | Toda et al. |
| 6,236,288 | B1 | 5/2001 | Tsujiguchi |
| 6,313,797 | B1 | 11/2001 | Kurita et al. |
| 6,498,542 | B1 | 12/2002 | Kuroda et al. |
| 6,737,943 | B2 | 5/2004 | Takubo et al. |
| 6,765,457 | B2 | 7/2004 | Tada et al. |
| 2001/0052832 | A1 | 12/2001 | Gotoh et al. |
| 2002/0109562 | A1 | 8/2002 | Tsukamoto et al. |
| 2003/0151468 | A1 | 8/2003 | Vangala et al. |
| 2009/0146761 | A1 | 6/2009 | Nummerdor |

FOREIGN PATENT DOCUMENTS

| | | |
|---|---|---|
| EP | 0 951 089 | 10/1999 |
| JP | 61 004303 | 1/1986 |
| JP | 61 258502 | 11/1986 |
| JP | 404242301 | 8/1992 |
| JP | 405167308 | 7/1993 |
| JP | 405275905 | 10/1993 |
| JP | 406216607 | 8/1994 |
| WO | WO 95/30250 | 11/1995 |

* cited by examiner

DUPLEX FILTER COMPRISED OF DIELECTRIC CORES HAVING AT LEAST ONE WALL EXTENDING ABOVE A TOP SURFACE THEREOF FOR ISOLATING THROUGH HOLE RESONATORS

CROSS-REFERENCE TO RELATED APPLICATIONS

This application claims the benefit of the filing date and disclosure of U.S. Provisional Patent Application Ser. No. 61/204,594 filed on Jan. 8, 2009, and is also a continuation-in-part of, and claims the benefit of the filing date and disclosure of, U.S. patent application Ser. No. 12/316,233 filed on Dec. 9, 2008, now U.S. Publication No. US2009/0146761-A1 published on Jun. 11, 2009, the entire disclosures of which are explicitly incorporated herein by reference as are all references cited therein.

TECHNICAL FIELD

This invention relates to dielectric block filters for radio-frequency signals and, in particular, to monoblock duplex filters.

BACKGROUND OF THE INVENTION

Ceramic block filters offer several advantages over lumped component filters. The blocks are relatively easy to manufacture, rugged, and relatively compact. In the basic ceramic block filter design, the resonators are formed by typically cylindrical passages, called through-holes, extending through the block from the long narrow side to the opposite long narrow side. The block is substantially plated with a conductive material (i.e. metallized) on all but one of its six (outer) sides and on the inside walls formed by the resonator through-holes.

One of the two opposing sides containing through-hole openings is not fully metallized, but instead bears a metallization pattern designed to couple input and output signals through the series of resonators. This patterned side is conventionally labeled the top of the block. In some designs, the pattern may extend to sides of the block, where input/output electrodes are formed.

The reactive coupling between adjacent resonators is dictated, at least to some extent, by the physical dimensions of each resonator, by the orientation of each resonator with respect to the other resonators, and by aspects of the top surface metallization pattern. Interactions of the electromagnetic fields within and around the block are complex and difficult to predict.

These filters may also be equipped with an external metallic shield attached to and positioned across the open-circuited end of the block in order to cancel parasitic coupling between non-adjacent resonators and to achieve acceptable stopbands.

Although such RF signal filters have received widespread commercial acceptance since the 1980s, efforts at improvement on this basic design continued.

In the interest of allowing wireless communication providers to provide additional service, governments worldwide have allocated new higher RF frequencies for commercial use. To better exploit these newly allocated frequencies, standard setting organizations have adopted bandwidth specifications with compressed transmit and receive bands as well as individual channels. These trends are pushing the limits of duplex filter technology to provide sufficient frequency selectivity, increased band isolation, decreased insertion loss, decreased band interference, and reduced cross-talk.

Coupled with the higher frequencies and crowded channels are the customer trends towards the use of the same printed circuit board and filter across the different operating frequencies of different frequency platforms and the consumer market trends towards ever smaller wireless communication devices and longer battery life. Combined, these trends place difficult constraints on the design of wireless components such as filters. Filter designers may not simply add more space-taking resonators (i.e., increase the size of the filter) or allow greater insertion loss in order to provide improved signal rejection.

SUMMARY OF THE INVENTION

The present invention is directed to a filter which comprises a core with a top surface, a bottom surface, and side surfaces. The core defines a first and second set of spaced-apart through-holes, and each of the through-holes extend through the core from an opening defined in the top surface to an opening defined in the bottom surface. At least first, second, and third posts extend outwardly from the top surface. The filter includes a surface-layer pattern of metallized and unmetallized areas on the core including a first connection area of metallization or electrode located on the top surface and extending onto the first post, a second connection area of metallization or electrode located on the top surface and extending onto the second post, and a third connection area of metallization or antenna located on the top surface and extending onto the third post.

In one embodiment, the first, second, and third posts define a top rim adapted to be seated against a top surface of a printed circuit board.

In one embodiment, at least first, second, and third walls extend upwardly from the top surface and the first, second, and third posts are formed on the first, second, and third walls respectively.

In one embodiment, the first and second walls are opposed to each other and the third wall connects the first and second walls and the plurality of walls and the top surface together define a cavity in the filter. In one embodiment, the respective posts are defined by respective slots formed in the respective walls. Still further, in one embodiment, another wall extends upwardly from the top surface and separates the openings of the respective first and second set of spaced-apart through-holes.

In one embodiment, the core is made of first and second blocks which have been coupled together and define the first and second set of spaced-apart through-holes respectively. Each of the first and second blocks includes at least one outer metallized outer surface which defines a central interior layer of metallization when the first and second blocks are coupled together along the respective outer metallized outer surfaces.

There are other advantages and features of this invention, which will be more readily apparent from the following detailed description of one embodiment of the invention, the drawings, and the appended claims.

BRIEF DESCRIPTION OF THE FIGURES

In the accompanying drawings that form part of the specification, and in which like numerals are employed to designate like parts throughout the same.

DETAILED DESCRIPTION OF THE PREFERRED EMBODIMENT

While this invention is susceptible to embodiment in many different forms, this specification and the accompanying drawings disclose one embodiment of the duplex filter in accordance with the present invention. The invention is, of course, not intended to be limited to the embodiment so described, however. The scope of the invention is identified in the appended claims.

Figure 2:
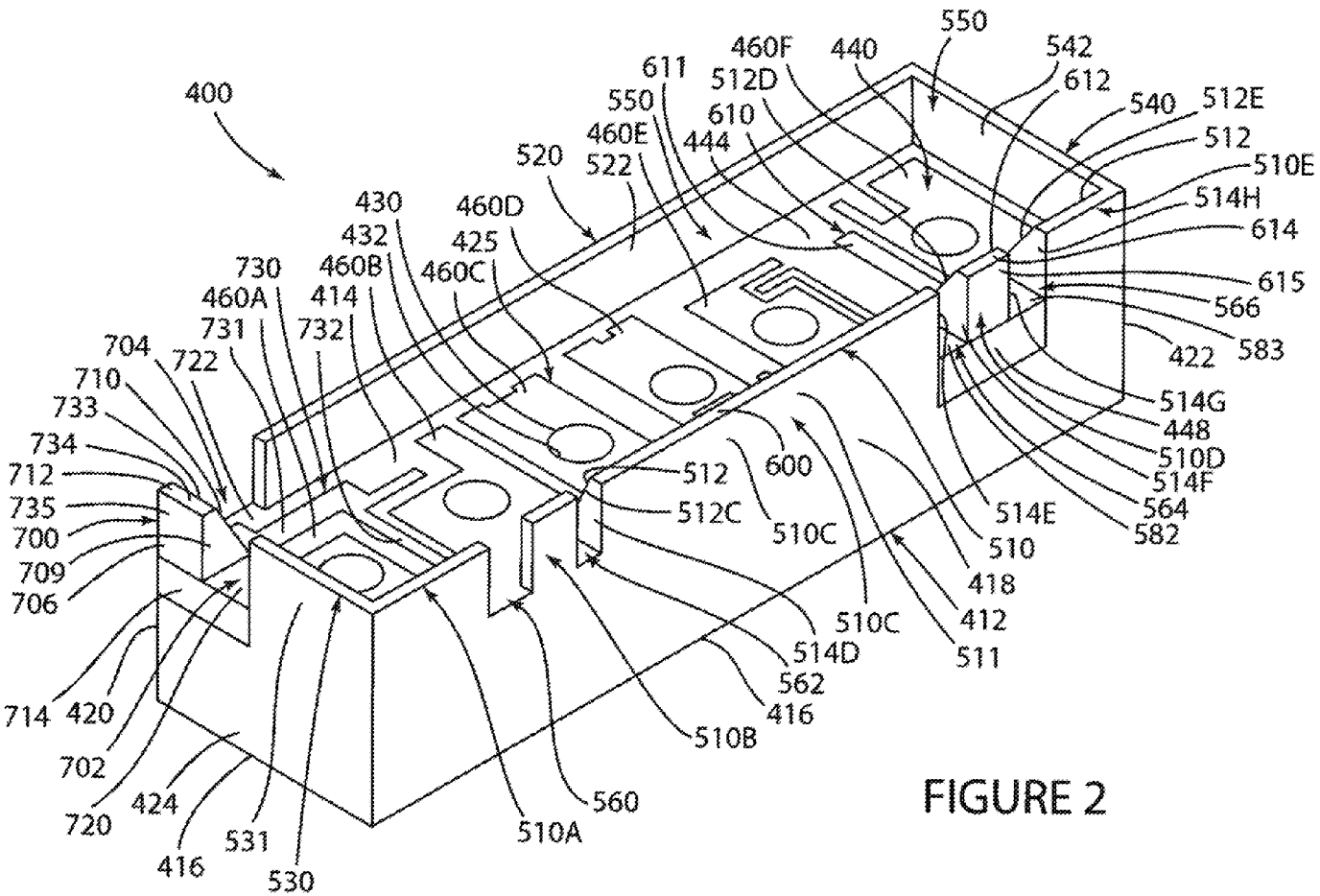
FIG. 2 is a top perspective view of the receive or high band filter or branch of the duplex filter of the present invention.
Figure 3:
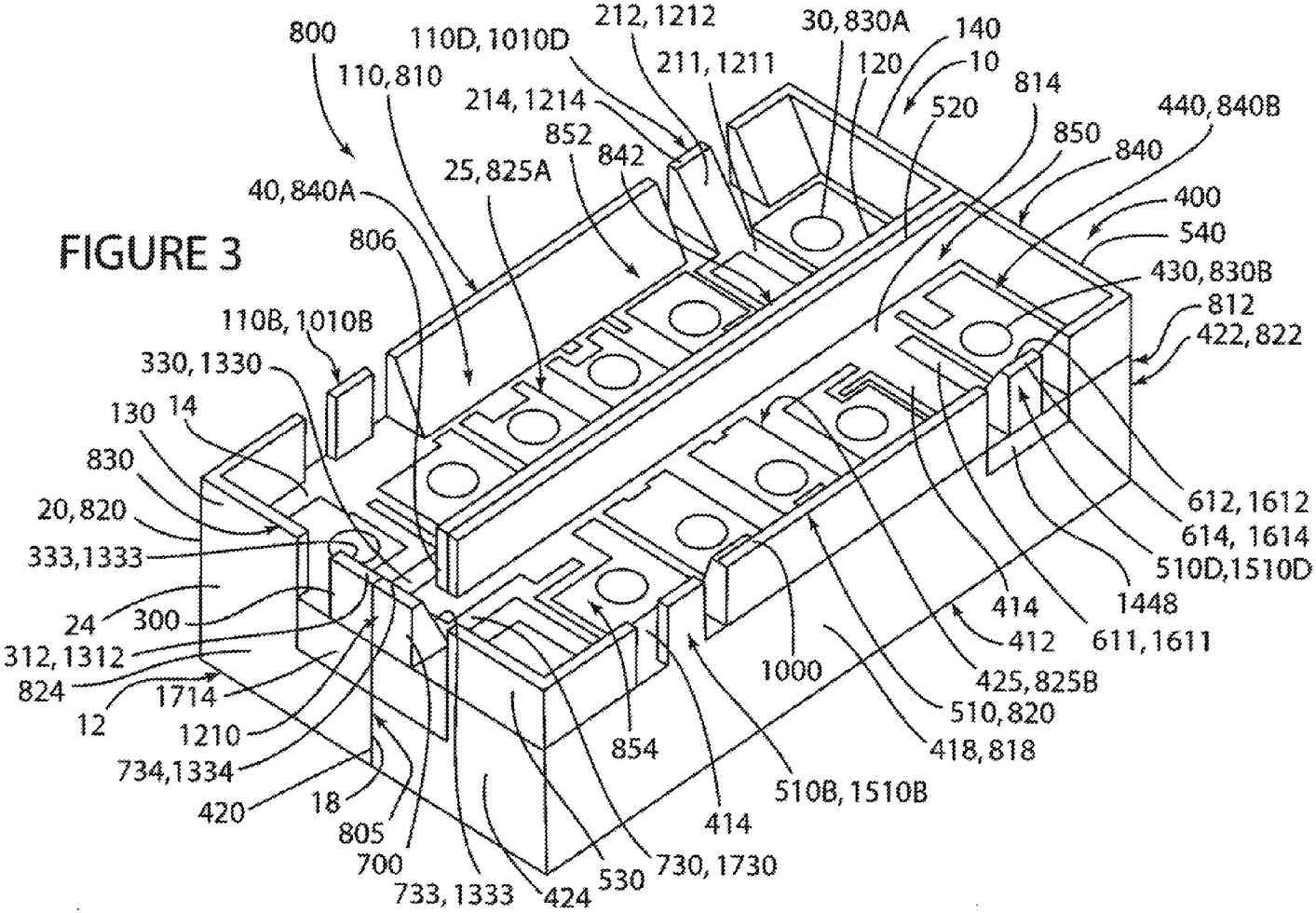
FIG. 3 is a top perspective view of one embodiment of the duplex filter in accordance with the present invention comprised of the FIG. 1 and FIG. 2 filters coupled together.

FIG. 3 depicts one embodiment of a duplex filter 800 in accordance with the present invention comprised of a transmit or low band simplex signal filter or branch 10 (FIG. 1) and a receive or high band simplex signal filter or branch 400 (FIG. 2) which have been appropriately coupled together in a side-by-side relationship as explained in more detail below.

Figure 1:
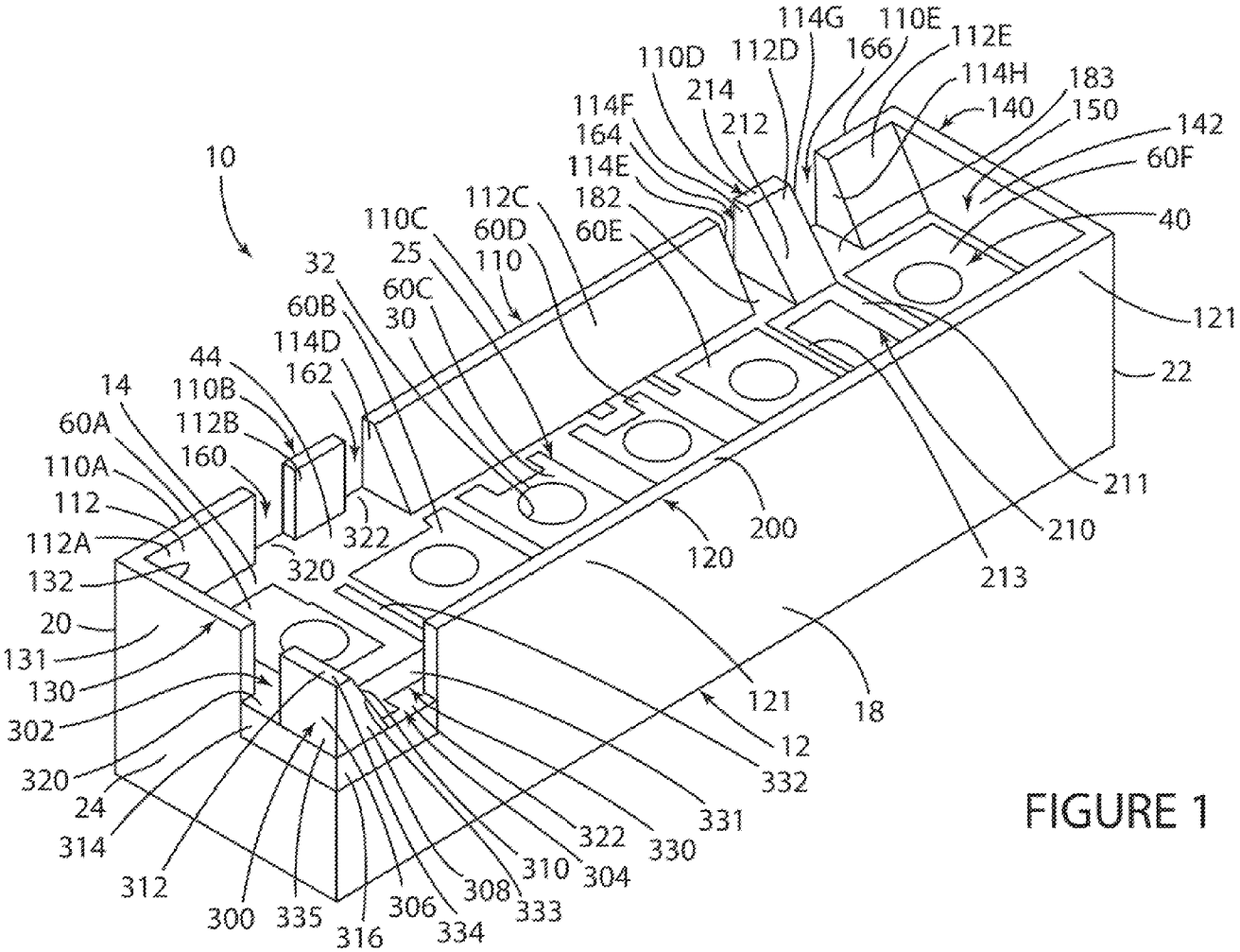
FIG. 1 is a top side perspective view of the transmit or low band filter or branch of the duplex filter of the present invention.

Referring to FIG. 1, transmit filter 10 of duplex filter 800 (FIG. 3) comprises a generally elongate, parallelepiped or box-shaped rigid block or core 12 comprised of a ceramic dielectric material having a desired dielectric constant. In one embodiment, the dielectric material can be a barium or neodymium ceramic with a dielectric constant of about 37 or above.

Core 12 defines an outer surface with six generally rectangular sides or surfaces: a top longitudinal surface 14; a bottom longitudinal surface 16 (FIG. 4) that is parallel to and diametrically opposed from top surface 14; a first side longitudinal surface 18; a second longitudinal side surface 20 (FIG. 4) that is parallel to and diametrically opposed from the first side longitudinal surface 18; a third transverse side or end surface 22; and a fourth transverse side or end surface 24 that is parallel to and diametrically opposed from the third transverse side or end surface 22.

Core 12 additionally defines four generally planar walls 110, 120, 130 and 140 that extend upwardly and outwardly away from the respective four outer peripheral edges of the top surface 14. Walls 110, 120, 130, 140 together define a peripheral top filter rim 200 and walls 110, 120, 130, 140 and top surface 14 together define a cavity 150 in the top of the filter 10.

Longitudinally extending walls 110 and 120 are parallel and diametrically opposed to each other. Transversely extending walls 130 and 140 are parallel and diametrically opposed to each other and are coupled to and generally normal with the walls 110 and 120.

Figure 4:
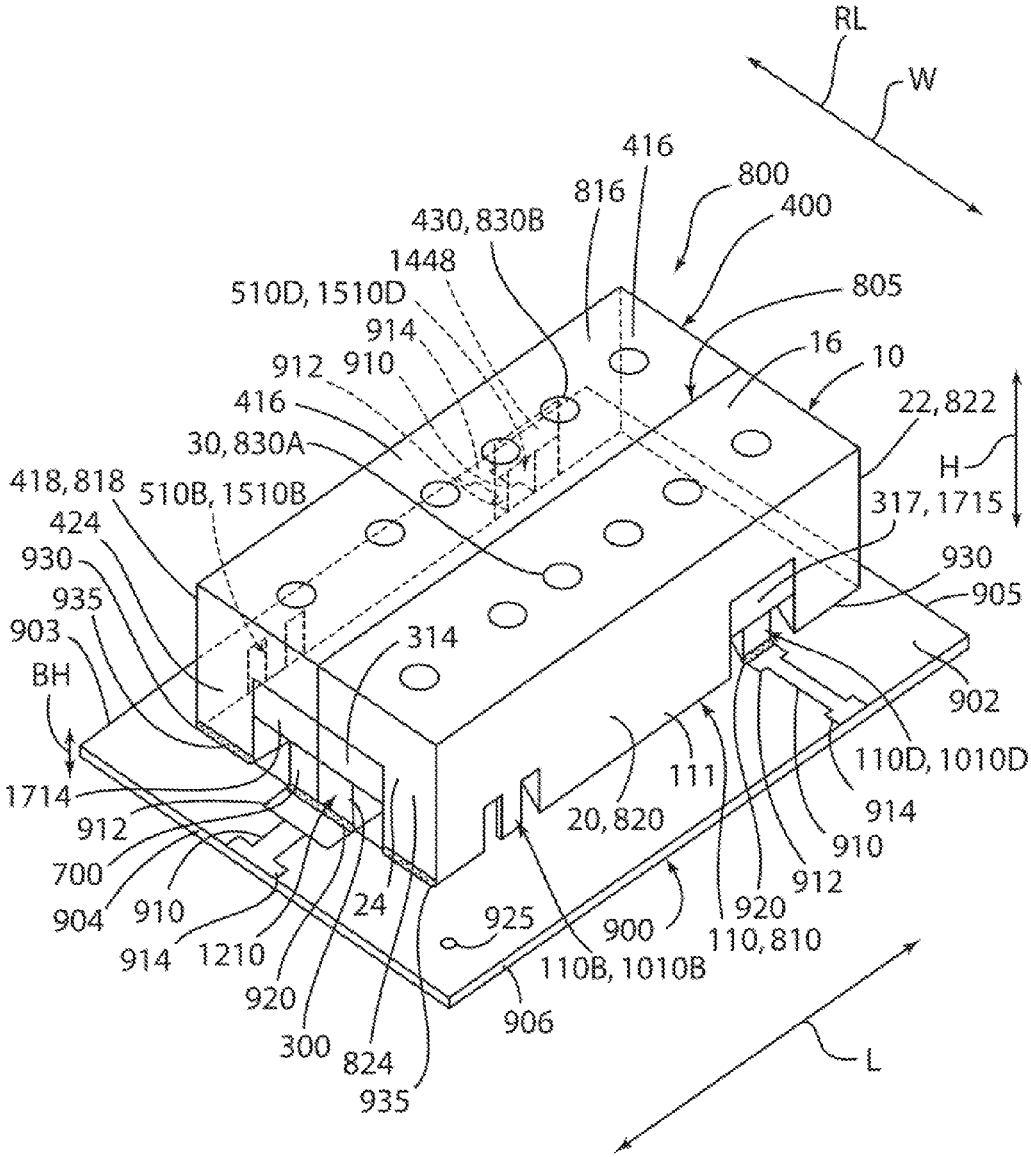
FIG. 4 is a top perspective view of the duplex filter of FIG. 3 mounted cavity/top side down to a customer's circuit board.

Wall 110 has an outer surface 111 (FIG. 4) and an inner surface 112. The outer surface 111 is co-extensive and co-planar with side surface 20 (FIG. 4). A central portion 110C of wall 110 includes an inner surface 112C which slopes or angles outwardly and downwardly away from the rim 200 into top surface 14 in the direction of opposed wall 120 at approximately a 45 degree angle relative to both the top surface 14 and the wall 110. Walls 120, 130 and 140 all define generally vertical outer walls generally co-planar with the respective core side surfaces and generally vertical inner walls that are generally substantially in a relationship that is normal to the horizontal plane defined by top surface 14.

Wall 110 additionally defines a plurality of generally parallel and spaced-apart wall portions. An end wall portion 110A is defined adjacent and normal to the wall 130. An upwardly extending isolated ground wall portion or post or finger 1108 is defined adjacent and spaced from the wall portion 110A. A slot 160 is defined between the end wall portion 110A and the post 110B. A central wall portion 110C is located adjacent but spaced from the post 110B. A slot 162 is defined between the post 110B and central wall portion 110C. An upwardly extending isolated wall portion or post or finger 110D is located adjacent but spaced from the central wall portion 110C. A slot 164 is defined between the central wall portion 110C and the post 110D. Post 110D is diametrically opposed to post 110B and is defined in an end portion of wall 110 adjacent the wall 140. An end wall portion 110E is defined between the wall 140 and the post 110D. Wall portion 110E is normal to the wall 140. A slot 166 is defined between the post 110D and the wall portion 110E.

Inner surface 112 of wall 110 is further separated into several portions including inner vertical portions 112A and 112B and inner angled or sloped surface portions 112C, 112D and 112E. Inner surface portion 112A is located on wall portion 110A. Inner surface portion 112B is located on wall portion or post 110B. Inner surface portion 112C is located on wall portion 110C. Inner surface portion 112D is located on wall portion or post 110D. Inner surface portion 112E is located on wall portion 110E.

Wall portions 110C, 110D, and 110E further define generally triangularly-shaped side walls. Specifically, wall portion 110C defines a side wall 114D spaced from post 110B and an opposed side wall 114E spaced from post 110D. Post 110D defines a side wall 114F spaced from wall portion 110C and a side wall 114G spaced from wall portion 110E. Wall portion 110E defines a side wall 114H spaced from post 110D.

Wall 120 has an outer surface 121 and an inner surface (not shown). Outer surface 121 is co-extensive and co-planar with the core side surface 18 and the inner surface (not shown) is normal with the core top surface 14.

Wall 130 has an outer surface 131 and an inner surface 132. Outer surface 131 is co-extensive and co-planar with the core side surface 24 and inner surface (not shown) is normal with the core top surface 14.

Wall 140 has an outer surface (not shown) and an inner surface 142. Outer surface (not shown) is co-extensive and co-planar with the core side surface 22 and inner surface 142 is normal with the core top surface 14.

An upwardly extending isolated wall portion or post or finger 300 is defined at a lower left corner of core 12 which bridges the core side surfaces 18 and 24. The post 300 is spaced from the walls 120 and 130 so as to define a slot 302 between the post 300 and wall 130 and a slot 304 between the post 300 and the wall 120. Post 300 defines a pair of generally triangularly-shaped side walls 308 which are not covered with metallization and are contiguous with the non-metallized area 44 as described in more detail below. The outside side wall 308 is co-planar with the side core surface 18 and the outside surface 121 of wall 120. Post 300 has a metallized top rim 312, a metallized front face 306 which is co-planar with the core end surface 24 and the outside surface 131 of wall 130, and a metallized inner angled or sloped surface 310.

Simplex transmit signal filter 10 additionally comprises a plurality of resonators 25 defined in part by a plurality of metallized through-holes 30 which are defined in dielectric core 12 and terminate in respective openings in the top and bottom surfaces 14 (FIG. 1) and 16 (FIG. 4) of the core 12.

Through-holes 30 extend along the length of the block 12 from a point adjacent the core side surface 22 to a point adjacent the opposed core side surface 24 in a spaced-apart, co-linear relationship. Each of the through-holes 30 is defined by an inner cylindrical metallized side-wall surface 32.

Top surface 14 of core 12 additionally defines a surface-layer recessed pattern 40 of respective electrically conductive metallized and insulative unmetallized areas or patterns. A portion of pattern 40 is defined on the top surface 14 of core 12 and thus defines a recessed filter pattern by virtue of its recessed location at the base of cavity 150 in spaced relationship from and with the top rim 200 of core walls 110, 120, 130, and 140.

The metallized areas may be a surface layer of conductive silver-containing material. Recessed pattern 40 also defines a wide area or pattern of metallization that covers the core bottom surface 16, all of the core side surfaces, and the side wall 32 of respective through-holes 30 and extends contiguously from within resonator through-holes 30 towards both core top surface 14 and core bottom surface 16 and may also be labeled a ground electrode which serves to absorb or prevent transmission of off-band signals.

The recessed pattern 40 on core top surface 14 is at least comprised of resonator pads 60A, 60B, 60C, 60D, 60E and 60F which at least partially surround the top openings of respective through-holes 30. Resonator pads 60A-60F are contiguous or connected with the metallization area that extends through the respective inner surfaces 32 of through-holes 30 and are shaped to have predetermined capacitive couplings to adjacent resonators and other areas of surface-layer metallization.

An unmetallized area or pattern 44 surrounds all of the metallized resonator pads 60A-60F; extends over at least portions of the core side surfaces 18, 20, and 24; onto core top surface slot portions 182, 183, 320 and 322; and onto core side wall portions 114E, 114F, 114G, 114H, and outside side wall 308 of the post 300.

Unmetallized area 44 also defines a generally rectangularly-shaped unmetallized area 314 which extends onto a portion of core side surface 24 located below the front face 306 of the post 300 and the slot 302. Another generally rectangularly-shaped unmetallized area 316 is coupled with the area 314 and extends onto a portion of core side surface 18 located below the outside side wall 308 of post 300 and the slot 304.

A similar generally rectangularly-shaped unmetallized area 317 (FIG. 4) extends onto a portion of the core side surface 20 located above the post 110D and slots 164 and 166.

Surface-layer pattern 40 on core top surface 14 additionally defines a pair of isolated conductive metallized signal areas: a transmit input/output signal connection area or electrode 210; and an antenna input/output signal connection area or electrode 330.

Input/output signal connection area 210 extends onto a portion of wall 110 and, more specifically, onto the inner surface and top rim portions 112 and 200 of RF signal input/output post 110D to define, for example, a surface mounting transmit signal conductive connection point or pad or contact as described in more detail below.

Connection area of metallization or electrode 210 is located adjacent the wall 140. Input connection area or electrode 210 includes electrode portions 211, 212, 213 and 214. Electrode portion 211 is located between resonator pads 60E and 60F and connects with electrode portion 212 that is located on inner surface portion 112D of post 110D. Electrode portion 213 connects with electrode portions 211 and 212. Electrode portion 214 is located on the top rim portion 200 of post 110D. Electrode portion 214 connects with the electrode portion (not shown) that is located on the outer surface of the post 110D. Electrode portion 214 is surrounded on all sides by unmetallized areas.

Antenna connection area 330 extends onto post 300 where it serves as an antenna surface mounting conductive connection point or pad or contact or post as described in more detail below.

Antenna connection area of metallization or electrode 330 is generally L-shaped and located adjacent the wall 120. Electrode 330 includes electrode portions 331, 332, 333, 334 and 335. Electrode portion 332 is located between resonator pads 60A and 608 and connects with electrode portion 331. Electrode portion 333 is located on the inner surface portion 310 of post 300 and connects with electrode portion 331. Electrode portion 334 is located on the top rim portion 200 of post 300 and connects with electrode portion 333. Electrode portion 335 is located on the outer surface 306 of post 300 and is surrounded on all sides by unmetallized areas.

The recessed surface pattern 40 includes metallized areas and unmetallized areas. The metallized areas are spaced apart from one another and are therefore capacitively coupled. The amount of capacitive coupling is roughly related to the size of the metallization areas and the separation distance between adjacent metallized portions as well as the overall core configuration and the dielectric constant of the core dielectric material. Similarly, surface pattern 40 also creates inductive coupling between the metallized areas.

Turning now to FIG. 2, simplex receive signal filter 400 comprises a generally elongate, parallelepiped or box-shaped rigid block or core 412 comprised of a ceramic dielectric material having a desired dielectric constant. In one embodiment, the dielectric material can be a barium or neodymium ceramic with a dielectric constant of about 37 or above.

Core 412 defines an outer surface with six generally rectangular sides: a core top longitudinal surface 414; a core bottom longitudinal surface 416 (FIG. 4) that is parallel to and diametrically opposed from the core top surface 414; a first core side longitudinal surface 418; a second core side longitudinal surface 420 that is parallel to and diametrically opposed from side surface 418; a third transverse core side or end surface 424; and a fourth transverse core side or end surface 422 that is parallel to and diametrically opposed from the core end surface 424.

Core 412 additionally defines four generally planar walls 510, 520, 530 and 540 that extend upwardly and outwardly away from the respective four outer peripheral edges of the core top surface 414. Walls 510, 520, 530, and 540 together define a top peripheral rim 600 and the walls 510, 520, 530, 540 and top surface 414 together combine to define a cavity 550 at the top of the filter 400.

Longitudinally extending walls 510 and 520 are parallel and diametrically opposed to each other. Transversely extending walls 530 and 540 are parallel and diametrically opposed to each other and are coupled to, and generally normal to, the walls 510 and 520.

Wall 510 has an outer surface 511 and an inner surface 512. Outer surface 511 is co-extensive and co-planar with the core side surface 418 while a portion of the inner surface 512 slopes or angles outwardly and downwardly away from the rim 600 into the core top surface 414 in the direction of opposed wall 520 at approximately a 45 degree angle relative to both the core top surface 414 and the wall 510. Walls 520, 530 and 540 all define generally vertical outer walls generally co-planar with the respective core side surfaces 420, 424, and 422 and generally vertical inner walls that are generally substantially in a relationship that is normal to the horizontal plane defined by the core top surface 414.

Wall 510 additionally defines a plurality of generally parallel and spaced-apart slots 560, 562, 564 and 566.

An end wall portion 510A is defined between the wall 530 and slot 560. End wall portion 510A is normal to the wall 530. An isolated ground wall portion or post or finger 510B is located adjacent but spaced from the wall portion 510A and the space therebetween defines the slot 560. A center wall portion 510C is located adjacent but spaced from the post 5106 and the space therebetween defines the slot 562. An isolated wall portion or post or finger 510D is located adjacent but spaced from the center wall portion 510C and the space therebetween defines the slot 564. Post 510D is diametrically opposed to post 510B. An end wall portion 510E is located adjacent but spaced from the post 510B and the space therebetween defines the slot 566. Posts 510B and 510D extend generally normally outwardly and upwardly away from the core top surface 414 of filter 400.

The inner surface of selected ones of the portions of wall 510 is angled or sloped. An inner angled surface portion 512C is located on wall portion 510C. An inner angled surface portion 512D is located on wall portion or post 510D. An inner angled surface portion 512E is located on wall portion 510E.

Wall portions 510C, 510D, and 510E further define generally triangularly-shaped side walls. Specifically, wall portion 510C defines a side wall 514D adjacent the post 510B and an opposed side wall (not shown) adjacent the post 510D. Post 510D defines a side wall 514F adjacent the wall portion 510C and a side wall 514G adjacent the end wall portion 510E. Wall portion 510E defines a side wall 514H adjacent the post 510D.

Wall 520 has an outer surface (not shown) and an inner surface 522. The outer surface (not shown) is co-extensive and co-planar with the core side surface 420 and the inner surface 522 is normal with the core top surface 414.

Wall 530 has an outer surface 531 and an inner surface (not shown). Outer surface 531 is co-extensive and co-planar with the core side surface 424 and the inner surface (not shown) is normal with the core top surface 414.

Wall 540 has an outer surface (not shown) and an inner surface 542. The outer surface (not shown) is co-extensive and co-planar with the core side surface 422 and the inner surface 542 is normal with the core top surface 414.

An isolated wall portion or post or finger 700 is defined at the upper left corner of core 412 in a relationship adjacent and spaced from respective walls 520 and 530. The space between post 700 and wall 530 defines a slot 702. The space between the post 700 and the wall 520 defines a slot 704. Post 700 defines a pair of generally triangularly-shaped side walls 709 which are not covered with metallization and are contiguous with non-metallized area 444 on the core top surface 414 as described in more detail below. Post 700 has a metallized top rim 712, a metallized front face 706 which is co-planar with the core side surface 424 and the outer surface 531 of wall 530, and a metallized inner angled or sloped surface 710. Post 700 extends generally normally upwardly and outwardly from the top filter surface 414. The outside wall 709 of post 700 is co-planar with the core side surface 420 and the outer surface (not shown) of the wall 520.

Receive filter 400 has a plurality of resonators 425 defined in part by a plurality of through-holes 430 (FIGS. 3 and 4) which are defined in dielectric core 412. Through-holes 430 extend from and terminate in respective openings defined in the top and bottom core surfaces 414 and 416 respectively. Through-holes 430 extend along the longitudinal axis of block 412 in a spaced-apart and co-linear relationship. Each of through-holes 430 is defined by an inner cylindrical metallized side-wall surface 432.

Top surface 414 of core 412 additionally defines a surface-layer recessed pattern 440 of electrically conductive metallized and insulative unmetallized areas or patterns. A portion of pattern 440 is defined on the top surface 414 of core 412 and thus defines a recessed filter pattern by virtue of its recessed location at the base of cavity 550 in spaced relationship from and with the top rim 600 of walls 510, 520, 530, and 540.

The metallized areas may be a surface layer of conductive silver-containing material. Recessed pattern 440 also defines a wide area or pattern or portion of metallization that covers the top, bottom, and side core surfaces 414, 416, 418, 420, 422, and 424, and the inner walls 432 of through-holes 430 and extends contiguously from within resonator through-holes 430 towards both top surface 414 and bottom surface 416 and may also be labeled a ground electrode and serves to absorb or prevent transmission of off-band signals.

The recessed pattern 440 on the core top surface 414 comprises a plurality of resonator pads 460A, 4606, 460C, 460D, 460E and 460F which at least partially surround the respective openings of through-holes 430 defined on the core top surface 414. Resonator pads 460A-460F are contiguous or connected with the metallization area that extends through the respective inner surfaces 432 of through-holes 430 and are shaped to have predetermined capacitive couplings to adjacent resonators and other areas of surface-layer metallization.

An unmetallized area or pattern 444 extends over portions of the core top surface 414 and at least portions of the core side surfaces 418, 420, and 424. Unmetallized area 444 on the core top surface 414 surrounds all of the metallized resonator pads 460A-460F. Unmetallized area 444 also extends onto and covers at least top surface slot portions 582, 583, 720 and 722 and side wall portions 514E, 514F, 514G, 514H, and 709.

Unmetallized area 444 also defines a generally rectangularly-shaped unmetallized area 714 which extends onto a portion of core side surface 424 located below the front face 706 of post 700 and the slot 702. Another generally rectangularly-shaped unmetallized area (not shown) is coupled to the unmetallized area 714 and extends onto a portion of the core side surface 420 located below the outside side face (not shown) of the post 700 and the slot 704.

A similar generally rectangularly-shaped unmetallized area 448 extends onto a portion of the core side surface 418 located below the front face of the post 510D and the slots 564 and 566.

Surface-layer pattern 440 on the core top surface 414 additionally defines a pair of isolated conductive metallized connection areas including a receive signal input/output connection area or electrode 610 and an antenna input/output signal connection area or electrode 730.

Receive signal connection area 610 extends onto a portion of wall 510 and side surface 418 and, more specifically, onto the inner surface and rim portions 512D and 600 respectively of post 510D to define a surface mounting receive signal conductive connection point or pad or contact or post as described in more detail below.

Electrode 610 is located on top surface 414 adjacent wall 540. Connection area or electrode 610 includes electrode portions 611, 612, 614 and 615. Electrode portion 611 is located between resonator pads 460E and 460F and connects with electrode portion 612 that is located on the inner surface portion 512D of post 510D and connects with electrode portion 611. Electrode portion 614 is located on the rim 600 of post 510D and connects with electrode portion 612. Electrode portion 615 is located on the outside face of the post 510D and connects with electrode portion 614 and is surrounded on all sides by unmetallized areas.

Antenna connection area or electrode 730 extends onto the post 700 to define a surface mounting conductive antenna connection point or pad or contact or post as described in more detail below.

Antenna connection area of metallization or electrode 730 is generally L-shaped and is located on the core top surface 414 adjacent the wall 530. Connection area or electrode 730 includes electrode portions 731, 732, 733, 734 and 735. Electrode portion 732 is located between resonator pads 460A and 460B and connects with electrode portion 731. Electrode portion 733 is located on the inner surface portion 710 of post 700 and connects with electrode portion 731. Electrode portion 734 is located on the top rim portion 600 of post 700 and connects with electrode portion 733. Electrode portion 735 is located on the outer surface 706 of post 700 and connects with electrode portion 734. Electrode portion 735 is surrounded on all sides by unmetallized areas.

The recessed surface pattern 440 includes metallized areas and unmetallized areas. The metallized areas are spaced apart from one another and are therefore capacitively coupled. The amount of capacitive coupling is roughly related to the size of the metallization areas and the separation distance between adjacent metallized portions as well as the overall core configuration and the dielectric constant of the core dielectric material. Similarly, surface pattern 440 creates inductive coupling between the metallized areas.

With specific reference now to FIG. 3, low band or transmit signal simplex filter 10 is joined or coupled to high band or receive signal simplex filter 400 to form and define one embodiment of the duplex filter 800 in accordance with the present invention.

Filters 10 and 400 can be joined by a wide variety of methods. For example, because the outer faces of the side longitudinal core surfaces 18 and 420 of respective filters 10 and 400 are covered with metallization, filters 10 and 400 and, more specifically, the side surfaces 18 and 420 and respective walls 120 and 520 thereof may be placed in a side-by-side coupling and abutting relationship and then the filters 10 and 400 can be heated in a furnace causing the metallization on the outer face of side wall 18 of filter 10 and the metallization on the outer face of side wall 420 of filter 400 to sinter and fuse together to form a unitary center metallized interior filter wall 805 which forms and defines a ground plane extending longitudinally along and through the center of the duplex filter 800 between the respective first and second sets of through-holes 830A and 830B to advantageously electrically separate and isolate the same. Filters 10 and 400 may also be joined together using conductive epoxies, solders or mechanical joining techniques.

Duplex filter 800 being, in one embodiment, composed of the combination of the individual and separate simplex filters 10 and 400, thus comprises a generally elongate parallelepiped or box-shaped rigid block or core 812 defined by the cores 12 and 412 of respective filters 10 and 400. Core 812 defines an outer surface with six generally rectangular sides or surfaces: a top longitudinal surface 814 defined by the joined top longitudinal surfaces 14 and 414 of respective filters 10 and 400; a bottom longitudinal surface 816 (FIG. 4) which is defined by the joined bottom longitudinal surfaces 16 and 416 as shown in FIG. 4 of respective filters 10 and 400 and is parallel to and diametrically opposed from the core top surface 814; a first side longitudinal surface 818 defined by the side longitudinal surface 418 of filter 400; a second side longitudinal surface 820 (FIG. 4) defined by the side surface 20 of filter 10 and parallel to and diametrically opposed from the core side surface 818; a third side or end transverse surface 822 (FIGS. 3 and 4) defined by the joined side surfaces 22 and 422 of respective filters 10 and 400; and a fourth side or end transverse surface 824 which is defined by the joined side surfaces 24 and 424 of respective filters 10 and 400 and is parallel to and diametrically opposed from the end surface 822. The core surfaces 822 and 824 are normal with the core surfaces 818 and 820. The interior filter wall 805 is parallel to the core surfaces 818 and 820.

Core 812 additionally defines four generally planar walls that extend upwardly and outwardly away from the respective four outer peripheral edges of the top surface 814: longitudinal wall 810 which is defined by the wall 110 of filter 10; longitudinal wall 820 which is opposed to wall 810 and is defined by the wall 510 of filter 400; transverse side wall 830 which is defined by the joined walls 130 and 530 of respective filters 10 and 400; and transverse side wall 840 which is opposed to the wall 830 and is defined by the joined walls 140 and 540 of respective filters 10 and 400.

Walls 810, 820, 830, and 840 together define a top circumferential rim 1000; and walls 810, 820, 830, and 840 and the core top surface 814 together define a top filter cavity 850. Walls 810 and 820 are parallel and diametrically opposed to each other. Walls 830 and 840 are parallel and diametrically opposed to each other and are coupled to and generally normal to the walls 810 and 820.

Longitudinal wall 810 defines a pair of spaced-apart, isolated posts or fingers 1010B and 1010D defined by and corresponding in location, structure, and function to the posts or fingers 110B and 110D respectively of filter 10, the description of which is incorporated herein by reference. Post 10108 is located adjacent wall 830 while post 1010D is located adjacent opposed wall 840.

Opposed longitudinal wall 820 defines a pair of spaced-apart, isolated posts or fingers 15106 and 1510D defined by and corresponding in location, structure, and function to the posts or fingers 510B and 510D respectively of filter 400, the description of which is incorporated herein by reference. Post 1510B is located adjacent transverse wall 830 and is diametrically opposed to the post 1010B. Post 1510D is located adjacent transverse wall 840 and is diametrically opposed to post 1010D.

Transverse side wall 830 defines an isolated generally centrally located post or finger 1210 which is defined by the coupling together of posts or fingers 300 and 700 of filters 10 and 400 respectively and, more specifically, by the coupling together of the respective outside faces thereof into an abutting relationship.

Filter 800 further comprises a central interior longitudinal wall 842 which is defined by the joined walls 120 and 520 of respective filters 10 and 400 and extends in a longitudinal direction through the center of filter 800 from the wall 840 and terminates in an end wall 806 spaced from the opposite wall 830. Wall 842 extends upwardly and outwardly away from the core top surface 814 of filter 800 in a relationship parallel to and spaced from the walls 810 and 820. Wall 842 splits, divides, and isolates the filter top surface 814 and cavity 850 into respective generally rectangularly-shaped upper and lower, generally parallel and adjoining transmit and receive filter sections or cavities 852 and 854 respectively.

Cavity or section 852 is defined between the respective filter walls 810 and 842 while cavity or section 854 is defined between the respective filter walls 820 and 842.

Section 852 includes a plurality of resonators 825A defined in part by a plurality of resonator through-holes 830A and a pattern 840A of electrically conductive metallized and insulative unmetallized areas or patterns on the core top surface 814 defined by and corresponding in location, structure, and function to the resonators 25, through-holes 30, and pattern 40 respectively of filter 10, the description of which is thus incorporated herein by reference.

Through-holes 830A extend longitudinally along the core top surface 814 of the block/core 812 in spaced-apart and parallel relationship above and parallel to the central interior wall 842. Each of the through-holes 830A extends through the core 812 and terminates in respective openings defined in the respective top and bottom surfaces 814 and 816 of the core 812.

The pattern 840A, post 1010D, and post 1210 of filter 800 includes respective strips of conductive material 1211, 1212, 1214, 1330, 1333, and 1312 defined by and corresponding in location, structure, and function to the respective strips of conductive material 211, 212, 214, 330, 333, and 312 of pattern 40, post 110D, and post 300 of filter 10, the description of which is thus incorporated herein by reference.

Section 854 includes a plurality of resonators 825B defined in part by a plurality of resonator through-holes 8306 which are diametrically opposed and parallel to resonator through-holes 830A and a pattern 840B of electrically conductive metallized and insulative unmetallized areas or patterns on the top surface 814 defined by and corresponding in location, structure, and function to the resonators 425, through-holes 430, and pattern 440 respectively of filter 400, the description of which is incorporated herein by reference.

Through-holes 830B extend longitudinally along the block/core 812 in a spaced-apart and parallel relationship below and parallel to central interior wall 842 and the through-holes 830A. Each of the through-holes 830B extend through the core 812 and terminate in respective openings defined in the respective top and bottom surfaces 814 and 816 of core 812.

The pattern 840B, post 1510D, and post 1210 of filter 800 include respective strips 1611, 1612, 1614, 1730, 1333, and 1334 of conductive material defined by and corresponding in location, structure, and function to the respective strips of conductive material 611, 612, 614, 730, 733, and 734 of pattern 440, post 510D, and post 700 respectively of filter 400, the description of which is thus incorporated herein by reference.

The patterns 840A and 840B additionally include a layer of metallization which covers the exterior filter surfaces 818, 820, 822, and 824; the exterior, interior, and rim of each of the walls 810, 820, 830, 840, and 842; and the interior of each of the resonator through-holes 830A and 830B with the exception of the unmetallized regions or areas 1448, 1714, and 1715 on the respective core side surfaces 818, 824, and 820. The unmetallized regions 1448, 1714, and 1715 (as shown in FIG. 4) are located below the posts 1510D, 1210, and 1010D respectively.

Thus, in the embodiment of FIG. 3, the transmit signal connection finger/post/pad/electrode 1010D is located on the longitudinal wall 810 of filter 800; the receive signal connection finger/post/pad/electrode 1510D is located on the opposite longitudinal wall 820 of filter 800 in a relationship diametrically opposed to the pad 1010D; and antenna connection finger/post/pad/electrode 1210 is located on the transverse wall 830 which couples the walls 810 and 820.

Additionally, it is understood that the central interior wall 842 isolates and separates the respective transmit and receive filter sections 852 and 854, the respective top surface metallization patterns 840A and 840B, and further that the respective through-holes 825A and 825B.

Turning now to FIG. 4, duplex filter 800 is shown therein mounted to a generally planar rectangular-shaped circuit board (PCB) 900. In one embodiment, circuit board 900 is a printed circuit board having a top surface 902, a bottom surface (not shown), and a plurality of side surfaces 903, 904, 905, and 906. Circuit board 900 has a board height BH that is measured along side 906 between the PCB top surface 902 and the bottom surface (not shown). Circuit board 900 additionally includes plated through-holes 925 that form an electrical connection between the PCB top and bottom surfaces. Several circuit lines 910 and connection pads 912 can be located on top surface 902 and connected with terminals 914. Circuit lines 910, connection pads 912, and terminals 914 are formed from a metal such as copper. Terminals 914 connect duplex filter 800 to an external electrical circuit (not shown).

Duplex filter 800 is mounted to the PCB 900 in a top side down relationship wherein the core top surface 814 is located opposite, parallel to, and spaced from the top surface 902 of PCB 900 and the rim 1000 (as shown in FIG. 3) defined by the walls 810, 820, 830, 840, and 842 of filter 800 is seated on and soldered to the top surface 902 of PCB 900. In this relationship, the cavity 850 defined by the filter 800 is partially sealed to define an enclosure defined by the top surface 814, the board surface 902, and the walls 810, 820, 830, 840, and 842.

It is further noted that, in this relationship, the generally vertical elongated through-holes 830A and 830B in duplex filter 800 are defined and oriented in a relationship generally substantially perpendicular to the PCB 900 wherein the openings of the respective through-holes 825A and 825B face, and are spaced from, the board top surface 902.

In the coupled relationship of FIG. 4, the antenna connection post or pad or electrode 1210 and, more specifically, the metallized rim portions 1312 and 1334 thereof on the rim 1000 (as shown in FIG. 3) are seated on and coupled to one of the metallized connection pads 912 of PCB 900 by solder 920. Similarly, transmit signal post or pad 1010D and, more specifically, the metallized rim portion 1214 is seated on and coupled to another one of the connection pads 912 on the board 900 by solder 920. Moreover, receive signal post or pad 1510D and, more specifically, the metallized rim portion 1614 thereof (as shown in FIG. 3) is likewise seated on and coupled to yet another connection pad 912 on the board top surface 902. The connection pads 912 in turn are coupled to the respective circuit lines 910.

It is noted that the location of the transmission/input and receive/output connection pads 1010D and 1510D on opposite longitudinal sides of the filter 800 advantageously reduces interference and cross-talk and further allows the respective transmission/input and receive/output circuit lines 910 to also be located on opposite longitudinal sides 903 and 906 of the board 900 to create better isolation and reduce interference between the respective circuit lines.

Circuit board 900 also has a generally rectangular-shaped ground ring or line 930 disposed on the top surface 902 that can be formed from copper and on which the rim of the respective electrodes and filter walls are attached by solder 935 (only a portion of which is shown in FIG. 4). For example, solders 920 and 935 are first screened onto ground ring 930 and connection pads 912 respectively. Next, duplex filter 800 is placed on top surface 902 such that electrode portions 1010D and 1210 are aligned with connection pads 912. Circuit board 900 and duplex filter 800 are then placed in a reflow oven to melt and reflow solders 920 and 935.

The attachment of the rim 1000 (as shown in FIG. 3) of the respective walls 810, 820, 830, 840, and 842 to the ground ring 930 forms an electrical path for the grounding of the majority of the outer surface of duplex filter 800.

As shown in FIG. 4, duplex filter 800 has a length L, a width W, a height H and a resonator length RL that is equal to H. For higher frequency filters that typically operate above 1.0 GHz, the design of the duplex filter 800 may require that the resonator length (RL) be less than or shorter than the board height (BH). In prior art filters that are mounted with either the bottom surface seated flat on the board (top surface facing up) or with one of the side surfaces seated flat on the board (top surface facing sideways), and where the resonator length becomes shorter then the board height, the filter can become unstable at higher frequencies when attached to the circuit board. Additional electromagnetic fields can be created that interfere with and reduce the attenuation of the filter. These additional electromagnetic fields can also reduce the attenuation and sharpness of the attenuation at the filter poles also known as zero points.

The use of duplex filter 800 of the present invention with recessed top surface patterns 840A and 840B on surface 814 (as all shown in FIG. 3) facing and opposite the board 900 provides improved grounding and off band signal absorption; confines the electromagnetic fields within cavity 850 (as shown in FIG. 3); and prevents external electromagnetic fields outside of cavity 850 (as shown in FIG. 3) from causing noise and interference such that the attenuation and zero points of the filter are improved.

The present invention allows the same footprint (length L and width W) to be used across multiple frequency bands. Prior art filters typically require a size or footprint that would either need to increase or decrease depending upon the desired frequency to be filtered. Filter 800 can have the same overall footprint and still be used at various frequencies.

Another advantage of the present invention is that, during solder reflow, filter 800 tends to self align with the ground ring 930 on the PCB 900. Filter 800 exhibits improved self alignment because the surface tension of the liquid solder 935 during reflow is distributed equally around the rims between ground ring 930 and the rims providing self-centering of the core 812.

The use of a duplex filter 800 also eliminates the need for a separate external metal shield or other shielding as currently used to reduce spurious electromagnetic interference incurred, as the walls 810, 820, 830, 840, and 842 and board 900 provide the shielding. Shielding could still be added, if needed or desired, to filter 800 for a specific application.

The present invention also provides improved grounding and confines the electrical fields within cavity 850 to create a filter 800 which exhibits steeper attenuation. As a result of the use of an interior cavity wall 842, isolation is also improved between the metallization patterns and resonator pads in the respective transmit and receive sections of the filter 800, thus allowing better harmonic suppression over conventional filters.

This present invention also further allows for the placement of input, output and antenna electrodes along any edge or wall of the filter 800. Although not shown, in one embodiment, the antenna electrode can be placed on the same side wall as either the transmit/input or receive/output electrodes or pads of the filter. In prior art surface mount filters, all of the electrodes are required to be on the same surface plane of the dielectric block.

Recessed patterns 840A and 840B still further create a resonant circuit that includes a capacitance and an inductance in series connected to ground. The shape of patterns 840A and 840B determines the overall capacitance and inductance values. The capacitance and inductance values are designed to form a resonant circuit that suppresses the frequency response at frequencies outside the passband including various harmonic frequencies at integer intervals of the passband.

While the embodiment shown depicts cavity 850 as being formed adjacent top surface 814, it is noted that the cavity and corresponding walls defining the same may be formed on any one or more of any of the other surfaces of the filter 800.

In still other embodiments, cavity 850 may only cover a portion of a surface or side of core 812. For example, cavity 850 may only encompass ten (10%) percent of the area of top surface 814. In another embodiment, multiple cavities may be located or formed on the same side or surface of core 812 by respective additional wall(s).

The present invention still further advantageously allows a duplex filter 800 to be formed simply by coupling together respective standard and simplex filters, thus simplifying the manufacturing process and reducing cost.

A duplex filter 800 having a length L of 16.17 mm., a height H of 5.1 mm., and a width W of 9.04 mm. was evaluated by computer simulation using microwave office computer simulation software. Simulated filter performance parameters are listed in TABLE 1, below.

TABLE 1

| | |
|---|---|
| High Pass Band | 925-930 Megahertz (MHz) |
| Low Pass Band | 880-915 Megahertz (MHz) |
| Isolation | 35.7 dB at 918 MHz |

Figure 5:
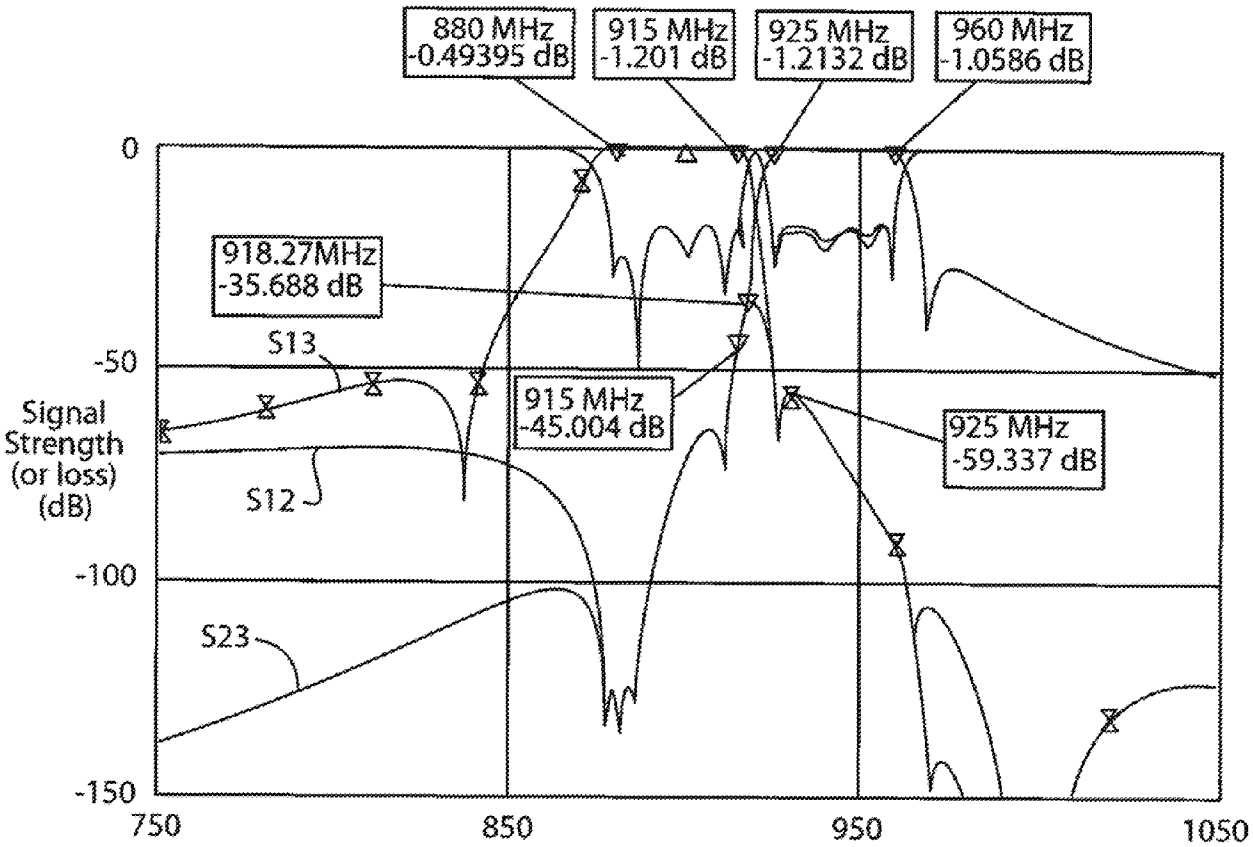
FIG. 5 is a graph of signal strength (or loss) versus frequency for the duplex filter of the present invention shown in FIGS. 3 and 4.

FIG. 5 is a graph of signal strength (or loss) in dB versus frequency in MHz demonstrating the specific simulated performance of duplex filter 800 in accordance with the present invention which shows that: the low passband or transmit passband is between 880 and 915 MHz and between −0.49395 dB and −1.201 dB respectively; the high passband or receive passband is between 925 MHz and 960 MHz and between −1.2132 dB and −1.0586 dB respectively; duplex filter 800 has a peak isolation (S23) between the receive and transmit ports of −35.688 dB at −918.27 MHz which is an improvement over prior art duplex filters; duplex filter 800 has an S12 value of −45.004 dB at the end of the transmit passband at 915 MHz; and an S13 value of −59.337 dB at the end of the receive passband at 925 MHz.

The present invention can be applied to an RF signal filter operating at a variety of frequencies. Suitable applications include, but are not limited to, cellular telephones, cellular telephone base stations, and subscriber units. Other possible higher frequency applications include other telecommunication devices such as satellite communications, Global Positioning Satellites (GPS), or other microwave applications.

Numerous variations and modifications of the embodiment described above may be effected without departing from the spirit and scope of the novel features of the invention. It is to be understood that no limitations with respect to the specific filter illustrated herein are intended or should be inferred. It is, of course, intended to cover by the appended claims all such modifications as fall within the scope of the claims.

I claim:

1. A filter comprising:

a core with a top surface, a bottom surface, and side surfaces, said core defining a longitudinal axis, a first plurality of through-holes extending longitudinally along the top surface of the core, a second plurality of through-holes extending longitudinally along the top surface of the core in a spaced-apart and generally parallel relationship to the first plurality of through-holes, the first and second plurality of through-holes being spaced-apart from and located on opposite sides of the longitudinal axis of the core, each of the through-holes of the first and second plurality of through-holes extending through the core from an opening defined in said top surface of said core to an opening defined in said bottom surface of said core;

at least first, second, and third posts extending outwardly from said top surface of said core; and a surface-layer pattern of metallized and unmetallized areas on said core, said pattern including a first connection area of metallization located on said top surface and extending onto said first post, a second connection area of metallization located on said top surface and extending onto said second post, and a third connection area of metallization located on said top surface and extending onto said third post.

2. The filter of claim 1, wherein each of the first, second, and third posts defines a top rim adapted to be seated against a top surface of a board.

3. The filter of claim 1, further comprising at least first, second, and third walls extending upwardly from said top surface, said first, second, and third posts being formed between respective pairs of slots defined in said first, second, and third walls respectively.

4. A filter comprising:

a core with a top surface, a bottom surface, and side surfaces, said core defining a first and second set of spaced-apart through-holes, each through-hole extending through the core from an opening defined in said top surface to an opening defined in said bottom surface;

at least first, second, and third posts extending outwardly from said top surface;

at least first, second, and third walls extending upwardly from said top surface, said first, second, and third posts being formed between respective pairs of slots defined in said first, second, and third walls respectively, the first and second walls being opposed to each other and the third wall connects the first and second walls; and a surface-layer pattern of metallized and unmetallized areas on said core, said pattern including a first connection area of metallization located on said top surface and extending onto said first post, a second connection area of metallization located on said top surface and extending onto said second post, and a third connection area of metallization located on said top surface and extending onto said third post.

5. A filter comprising:

a core with a top surface, a bottom surface, and side surfaces, said core defining a first and second set of spaced-apart through-holes, each through-hole extending through the core from an opening defined in said top surface to an opening defined in said bottom surface;

at least first, second, and third posts extending outwardly from said top surface; and a surface-layer pattern of metallized and unmetallized areas on said core, said pattern including a first connection area of metallization located on said top surface and extending onto said first post, a second connection area of metallization located on said top surface and extending onto said second post, and a third connection area of metallization located on said top surface and extending onto said third post, the core being made of first and second blocks which have been coupled together and define said first and second set of spaced-apart through-holes respectively, each of the first and second blocks including at least one outer metallized outer surface defining an interior layer of metallization when said first and second blocks are coupled together along said respective outer metallized outer surfaces.

6. A filter comprising:

a block with a top surface, a bottom surface, and at least one side surface, the block defining a first plurality of through-holes extending between respective openings defined in the top and bottom surfaces, and a second plurality of through-holes extending between respective openings defined in the top and bottom surfaces of the block and in a relationship spaced-apart from and generally parallel to the first plurality of through-holes;

a plurality of walls extending outwardly from the top surface of the block including a first wall, a second wall opposed to the first wall, and a third wall extending between the first and second walls; and a first pattern of metallized and unmetallized areas defined on the top surface of the block in the region of the openings defined by the first plurality of through-holes and including an input electrode and a first antenna electrode defined on the top surface and the input electrode extending onto the first wall, a second pattern of metallized and unmetallized areas defined on the top surface of the block in the region of the openings defined by the second plurality of through-holes and including an output electrode and a second antenna electrode separate from the first antenna electrode and defined on the top surface and the output electrode extending onto the second wall, and the first and second antenna electrodes defined on the top surface both extending onto the third wall.

7. The filter of claim 6, wherein the plurality of walls and the top surface together define a cavity in the filter.

8. The filter of claim 6, wherein one or more of the plurality of walls defines a plurality of pairs of slots forming at least first, second, and third posts between the plurality of pairs of slots respectively, the input, output, and antenna electrodes extending onto the first, second, and third posts respectively.

9. The filter of claim 8, wherein the plurality of pairs of slots forming said at least first, second, and third posts are defined in the first, second, and third walls respectively.

10. A filter comprising:

a block with a top surface, a bottom surface, and at least one side surface, the block defining a first plurality of through-holes extending between respective openings defined in the top and bottom surfaces, and a second plurality of through-holes extending between respective openings defined in the top and bottom surfaces of the block and in a relationship spaced-apart from and generally parallel to the first plurality of through-holes;

a plurality of walls extending outwardly from the top surface of the block including a first wall, a second wall opposed to the first wall, and a third wall extending between the first and second walls;

a fourth wall extending outwardly from the top surface of the block, the fourth wall being located between and separating the first and second patterns and the respective openings of the first and second plurality of through-holes defined on the top surface of the block; and a first pattern of metallized and unmetallized areas defined on the top surface of the block in the region of the openings defined by the first plurality of through-holes and including an input electrode defined on the top surface and extending onto the first wall, a second pattern of metallized and unmetallized areas defined on the top surface of the block in the region of the openings defined by the second plurality of through-holes and including an output electrode defined on the top surface and extending onto the second wall, and each of the first and second patterns of metallized and unmetallized areas including an antenna electrode defined on the top surface and both extending onto the third wall.

11. A filter comprising:

a block with a top surface, a bottom surface, and at least one side surface, the block defining a first and second set of through-holes extending between respective openings defined in the top and bottom surfaces;

a plurality of walls extending outwardly from the top surface;

a pattern of metallized and unmetallized areas defined on the top surface of the block including an input electrode defined on the top surface and extending onto a first one of the plurality of walls, an output electrode defined on the top surface and extending onto a second one of the plurality of walls, and an antenna electrode defined on the top surface and extending onto a third one of the plurality of walls; and an interior wall of metallization in the block which separates said first and second set of through-holes.

12. A filter comprising:

a block with a top surface, a bottom surface, and at least one side surface, the block defining a first and second set of through-holes extending between respective openings defined in the top and bottom surfaces;

a plurality of walls extending outwardly from the top surface;

a pattern of metallized and unmetallized areas defined on the top surface of the block including an input electrode defined on the top surface and extending onto a first one of the plurality of walls, an output electrode defined on the top surface and extending onto a second one of the plurality of walls, and an antenna electrode defined on the top surface and extending onto a third one of the plurality of walls; and an interior wall of metallization in the block which separates said first and second set of through-holes and the block is composed of first and second separate blocks which have been coupled together and said first and second set of through-holes are defined on said first and second separate blocks respectively.

13. A filter adapted to be seated on a board, the filter comprising:

a core of dielectric material including a top surface with first and second patterns of metallized and unmetallized areas and defining a longitudinal axis;

a first and second set of through-holes extending through the core in a relationship spaced from and generally parallel to the longitudinal axis of the core and terminating in openings in the top surface; and at least a first wall of dielectric material extending outwardly from the top surface and in the same direction as the longitudinal axis of the core which separates said first and second patterns of metallized and unmetallized areas on the top surface of the core, the filter being seated on the board in a relationship wherein the top surface of the core is opposed and spaced from the board.

14. The filter of claim 13, wherein the core includes an interior layer of metallization which separates the first and second set of through-holes extending through the core.

15. The filter of claim 14, wherein the core is comprised of first and second blocks of dielectric material which are coupled together and include said first and second set of through-holes respectively and each of the first and second blocks of dielectric material include an exterior layer of metallization defining said interior layer of metallization when the first and second blocks of dielectric material are coupled together.

* * * * *